US011793249B2

(12) United States Patent
Green et al.

(10) Patent No.: US 11,793,249 B2
(45) Date of Patent: Oct. 24, 2023

(54) WATER RESISTANT PROTECTIVE WASH GARMENT

(71) Applicants: Nancy A Green, Little Rock, AK (US); David Michael Morelock, Escondido, CA (US)

(72) Inventors: Nancy A Green, Little Rock, AK (US); David Michael Morelock, Escondido, CA (US)

(73) Assignee: David Michael Morelock, Escondido, CA (US)

( * ) Notice: Subject to any disclaimer, the term of this patent is extended or adjusted under 35 U.S.C. 154(b) by 0 days.

(21) Appl. No.: 15/973,002

(22) Filed: May 7, 2018

(65) Prior Publication Data

US 2019/0335825 A1 Nov. 7, 2019

(51) Int. Cl.
*A41D 13/04* (2006.01)
*A41D 13/00* (2006.01)
(Continued)

(52) U.S. Cl.
CPC ..... *A41D 13/0012* (2013.01); *A41D 13/04* (2013.01); *A41D 15/002* (2013.01);
(Continued)

(58) Field of Classification Search
CPC .. A41D 13/0012; A41D 13/04; A41D 12/002; A41D 27/201; A41D 27/208;
(Continued)

(56) References Cited

U.S. PATENT DOCUMENTS 1,181,891 A * 5/1916 Hulbert ..... A41D 3/04 2/87
2,473,740 A * 6/1949 Welch ..... A41D 13/04 2/48
(Continued)

FOREIGN PATENT DOCUMENTS

DE 202012002171 U1 * 6/2013 ..... D04B 21/16
DE 202012002171 U1 6/2013
(Continued)

OTHER PUBLICATIONS

Copenheave, Blaine R., International Search Report and Written Opinion received from the USRO dated Jul. 9, 2019, 12 pgs.

*Primary Examiner* — Katharine G Kane
(74) *Attorney, Agent, or Firm* — JAQUEZ LAND GREENHAUS & McFARLAND LLP; Bruce W. Greenhaus, Esq.

(57) ABSTRACT

A protective wash garment for use by workers during washing operations is disclosed. The protective wash garment is comprises a two-layer construction in which the first layer is a water resistant material. The second layer is a high porosity material that is laid over the first layer. Water that comes into contact with the second layer passes through and is caught between the first and second layer. The water then falls to the bottom of the first layer into a gutter formed by folding a bottom flap of the first layer up. The bottom flap is folded such that the gutter runs at an angle to urge the water that falls into the gutter to flow to a lower end of the gutter. The lower end of the gutter is beyond the feet of the worker wearing the garment. Thus, water spayed upon the garment falls into the gutter and flows out away from the feet of the worker wearing the garment.

12 Claims, 13 Drawing Sheets

(51) Int. Cl.
*A41D 31/04* (2019.01)
*A41D 15/00* (2006.01)
*A41D 27/20* (2006.01)
*A41D 31/02* (2019.01)

(52) U.S. Cl.
CPC ..... *A41D 27/201* (2013.01); *A41D 27/208* (2013.01); *A41D 31/02* (2013.01); *A41D 2300/324* (2013.01); *A41D 2600/20* (2013.01)

(58) Field of Classification Search
CPC ..... A41D 31/02; A41D 2300/324; A41D 2600/20; Y10T 428/2419; Y10T 428/24198; Y10T 428/24215; Y10T 428/24752; Y10T 428/2475; Y10T 428/2477; Y10T 442/164; Y10T 442/167; Y10T 442/169; Y10T 442/3854–3894
See application file for complete search history.

(56) References Cited

U.S. PATENT DOCUMENTS 2,551,907 A 5/1951 Serebrin
2,616,598 A * 11/1952 Sexton ..... A01K 97/06 2/48
4,660,226 A * 4/1987 Quilling ..... A41B 13/103 2/49.4
6,000,056 A * 12/1999 Brady ..... A41B 13/103 2/49.1
9,944,120 B1 * 4/2018 Butler ..... B60B 33/0063
2002/0098312 A1 * 7/2002 Sloot ..... A41D 13/01 428/45
2002/0106951 A1 * 8/2002 Buttars ..... D03D 15/593 442/6
2005/0144693 A1 * 7/2005 Hagen ..... A41B 13/10 2/49.1
2012/0030861 A1 * 2/2012 Miller ..... A41D 13/0012 2/221
2016/0219949 A1 * 8/2016 Alexander ..... B60N 2/6036
2018/0243486 A1 * 8/2018 Blackwell ..... A41D 13/1245
2019/0133225 A1 * 5/2019 Brown ..... B32B 5/022

FOREIGN PATENT DOCUMENTS

GB 372670 A * 5/1932 ..... A41D 13/04
WO 97/28707 8/1997
WO WO-9728707 A1 * 8/1997 ..... A41B 13/10
WO 2019217017 11/2019

* cited by examiner

WATER RESISTANT PROTECTIVE WASH GARMENT

BACKGROUND

(1) Technical Field

Various embodiments described herein relate to water resistant protective garments for use during washing activities and more particularly to a protective wash garment that prevents liquids from making contact with the user and dripping into the shoes of a user during washing activities.

(2) Background

Several washing activities, such as washing dishes within a commercial kitchen of a restaurant, washing cars at a car wash or washing pets in a kennel or pet shop, are performed by millions of workers as a condition of their employment. In addition, millions of others wash their own cars, pets, lawn furniture, etc. In many cases, these washing activities involve spraying water from a nozzle attached to a hose. The water is typically sprayed onto the item to be washed. In other cases, water is applied to the item to be washed from nozzles attached to washing stations or equipment within a washing station, such as the equipment that is present at a car wash. In many such cases, the person performing the washing activity or otherwise participating in the washing activity, will wear a water resistant garment, such as an apron or rain suit, to prevent the clothing of the person involved in the washing activity from getting the wet. Nonetheless, for decades, hundreds of thousands of workers, such as dishwashers in restaurants, hospitality workers, and workers involved in the work of other industries have been working long, hard workdays with uncomfortably wet shoes and feet.

Typically, the shoes and feet of these workers get wet because water that collects on the surface of the worker's protective apron or other outer garment drips down the surface of the garment and drains off the lower edge of the garment onto (and often into) the shoes of the worker. One common solution to this problem is for the worker to wear rubber wash boots. However, rubber wash boots are uncomfortable. In particular, in addition to the discomfort that comes from the additional weight and feel of such boots, such boots get clammy, adding to the discomfort that accompanies wearing such boots throughout the workday. Many times, the discomfort that accompanies wearing such boots leads workers to choose to wear more comfortable footwear, such as tennis shoes, and deal with the discomfort of working with wet feet. That is, as uncomfortable as it is to work with wet feet, it may nonetheless be a more comfortable option than contending with the discomfort that accompanies wearing water resistant wash boots throughout the workday. In many instances, these workers are low paid and underserved, but mission critical employees whose comfort is of concern to their employer, but for whom the solution to their discomfort has long been elusive. Accordingly, there is a need for a solution that will protect people engaged in such washing activities from having to choose to either endure the discomfort of wet feet or wear undesirable and uncomfortable wash boots.

SUMMARY OF THE INVENTION

A water resistant protective wash garment is disclosed herein that captures water on its surface and provides a mechanism to drain the water away from the feet of the person wearing the garment. In accordance with some embodiments, the garment comprises two layers. In some embodiments, the garment is an apron. The first layer is formed from a water resistant material extending from the shoulders of the person wearing the apron to just above the person's feet. In some embodiments, the water resistant material is waterproof.

The second layer of the garment is formed from a high porosity material. In some embodiments, the second layer is a mesh material (i.e., a material having a mesh structure). In some embodiments, the second layer covers a substantial portion of the front surface of the first layer. The second layer captures water that, absent the second layer, would bounce off the first layer. In embodiments in which the second layer is a mesh, the mesh construction of the second layer allows water to penetrate through to the first layer, but captures water that would otherwise bounce off the first layer and subsequently fall upon the wearer's feet. The water that is captured by this two-layer construction drains to the bottom of the first layer. A bottom flap of the first layer is folded up to form a gutter that guides the water to the side of the garment. The water, thus, pours out of the gutter and onto the floor at a distance from the wearer's feet. A piping is provided at the lip of the bottom flap to provide stability to the shape of the gutter and to make it less likely that water will spill out over the lip onto the shoes of the worker wearing the garment.

The details of one or more embodiments of the disclosed apron are set forth in the accompanying drawings and the description below. Other features, objects, and advantages of the disclosed will be apparent from the description and drawings, and from the appended claims provided herewith.

DESCRIPTION OF THE DRAWINGS

Like reference numbers and designations in the various drawings indicate like elements.

DETAILED DESCRIPTION OF THE INVENTION

Figure 1:
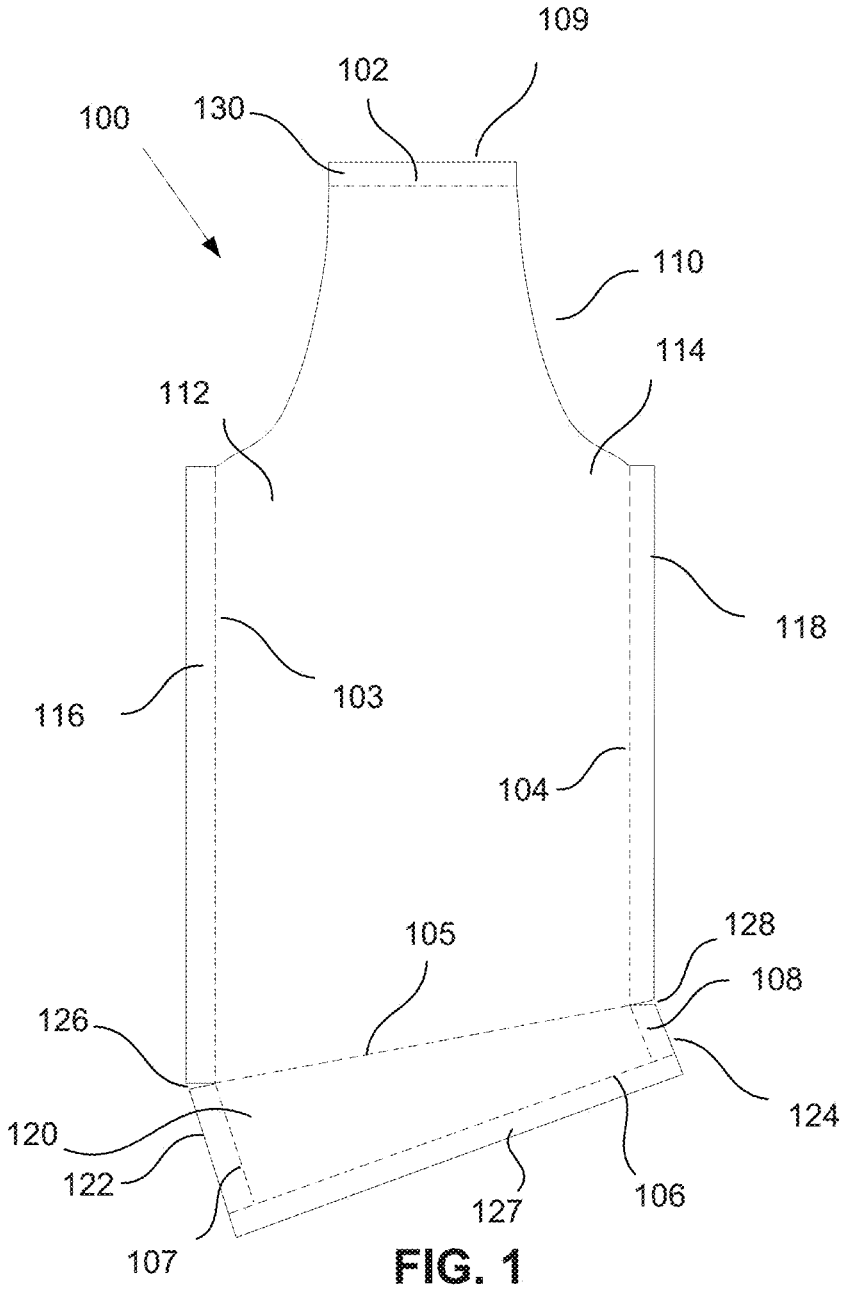
FIG. 1 is a plan view drawing of the first layer of the two-layer apron in accordance with one embodiment of the presently disclosed protective wash garment.

FIG. 1 is a plan view drawing of the material used to form the first layer 100 of embodiment of the disclosed protective wash garment in which the garment conforms to the shape of an apron. In particular, the embodiment of FIG. 1 illustrates the first layer 100 of a two-layer apron in accordance with one embodiment of the presently disclosed protective wash garment. Dotted lines 102, 103, 104, 105, 106, 107, 108 indicate fold lines along which the first layer 100 will be folded during the manufacture of the apron. While an apron is used to illustrate the disclosed protective wash garment, it will be clear to those skilled in the art that the concepts of the present disclosure would apply equally well to other garments, such as jackets, shirts, ponchos, etc.

The first layer 100 is fabricated from a water resistant material. In some embodiments, the material of the first layer 100 is a waterproof fabric. Water resistant fabrics are inherently resistant to penetration by water and wetting or, alternatively, are treated to become resistant. They are usually natural or synthetic fabrics that are laminated or coated with a waterproofing material such as rubber, polyvinyl chloride (PVC), polyurethane (PU), silicone elastomer, fluoropolymers, or wax. A fabric may be treated either before or during manufacture of completed products. In other embodiments, the fabric may be treated after manufacture, for instance by a waterproofing spray. One common waterproofing treatment includes the application of C6 fluorocarbon-based finishes and alternative chemistries. More particularly, one such as process is ChemStik technology, a solvent-free process involving the on-surface polymerization of hydrocarbon chains. However, it should be understood by those skilled in the art that any effective water resistant material from which the two-layer garment disclosed herein can be fabricated would be within the scope of this disclosed protective wash garment.

The pattern of the first layer 100 is such that the top portion 109 of the first layer 100 forms a chest covering that will cover the wearer from the neckline down to the breast area with increasing width. The garment is shaped to allow the arms of the wearer to extend from an arm region 110 of the apron and thus allow a worker wearing the garment to move his arms freely about. The first layer 100 reaches full width just below the arm region 110 to allow a right side panel 112 and a left side panel 114 of the apron to extend under the wearer's arms, covering at least a portion of the wearer's sides and back. A right side flap portion 116 and a left side flap portion 118 extend from the right side panel 112 and from the left side panel 114, respectively. It should be noted that "right side" and "left side" are with reference to the wearer. Therefore, the left side panel 114 is the panel of the first layer 100 that would wrap around the left side of the wearer.

A bottom flap 120 extends from the bottom portion of the first layer 100. A bottom right side flap 122 extends from the first side of the bottom flap 120 and a bottom left side flap 124 extends from the left side of the bottom flap 120. The bottom right side flap 122 is defined on the left side by the fold line 107 and at the bottom by fold line 106. In some embodiments, a notch 126 is cut between the right side flap portion 116 and the bottom right side flap 122 to allow the two flaps 116, 122 to fold neatly along their respective fold lines 103, 107. However, the need for such a notch 126 will depend in part upon the thickness and flexibility of the material from which the first layer 100 is fabricated. A bottom center flap 127 is defined by the fold line 106 and the lower boundary of the bottom flap 120.

The bottom left side flap 124 is defined on the right side by the fold line 108 and at the bottom by fold line 106. In some embodiments, a notch 128 is cut between the left side flap portion 118 and the bottom left side flap 124 to allow the two flaps 118, 124 to fold neatly along their respective fold lines 104, 108. However, similar to the notch 126, the need for such a notch 128 will depend in part upon the thickness and flexibility of the material from which the first layer 100 is fabricated. A neck flap 130 is defined by the fold line 102.

Figure 2:
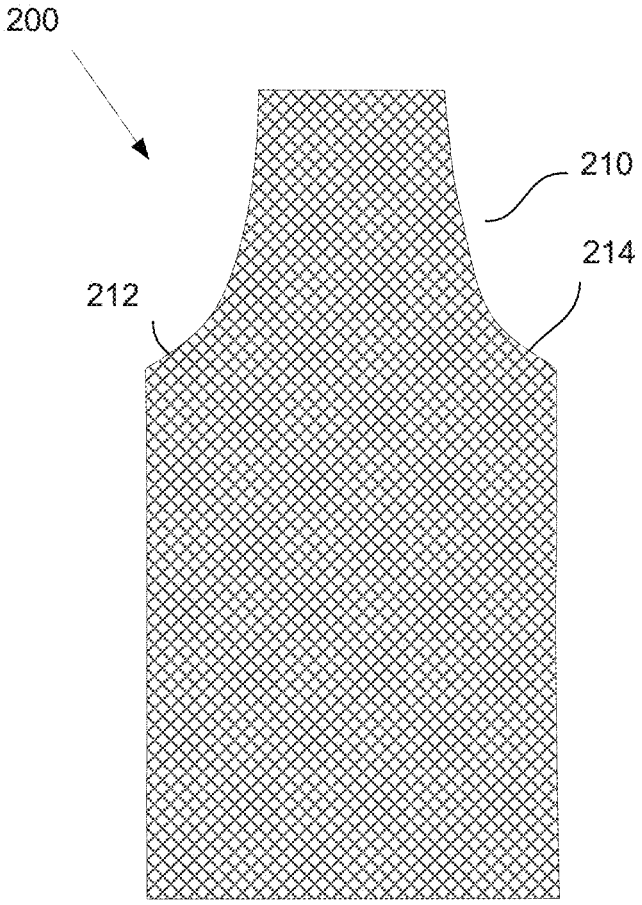
FIG. 2 is a plan view drawing of the second layer of the two-layer apron in accordance with one embodiment of the presently disclosed protective wash garment.

FIG. 2 is a plan view drawing of the second layer 200 of the two-layer apron in accordance with some embodiments of the disclosed protective wash garment. In some embodiments, the second layer 200 comprises a high porosity material. In some embodiments, portions of the second layer have a high porosity due to having a mesh structure (i.e., being at least partially of a mesh material), such as fiberglass screening, vinyl coated fiberglass screening, etc. In some alternative embodiments, other materials may be used that provide a mesh in at least a portion of the second layer 200. For the purposes of this disclosure, a mesh structure is any structure having "holes" through which droplets can pass and includes at least fine screens. In some embodiments, such a mesh structure is formed by a network of cords, wires or threads in which the cords, wires, threads, etc. may be formed from any one from among a group of materials, such as polypropylene, fiberglass, vinyl, etc. In alternative embodiments, the mesh structure can be formed by forming holes in accordance with a pattern that is either random or periodic. Such holes can be punched, formed during the manufacture of the material, cut, or otherwise produced in the material, either during production of the material or after production. Alternately, the second layer could be formed from terrycloth, a cotton sheet, or synthetic porous breathable material, or a sponge type of material.

The second layer 200 provides a mechanism by which water passes through the second layer and is trapped between the first layer 100 and the second layer 200. That is, the mesh is sufficiently permeable that water that splashes or sprays onto the second layer 200 will penetrate the second layer 200 and adhere to the underlying first layer 100. Alternatively, the water may accumulate on the surfaces of the second layer, in addition to water that accumulates on the surface of first layer 100. As the water accumulates between the first and second layers 100, 200, the water flows down along the surface of one or both of the layers 100, 200. Other high porosity materials that serve to capture water that contacts the outward facing surface of the garment and allow the water to run down the outward facing surface can be used as well.

The second layer 200 is shaped to lie within the outline of the first layer 100. Accordingly, the second layer 200 has arm regions 210, a right side panel 212 and a left side panel 214 similar to the contour of the arm regions 110 and side panels 112, 114 of the first layer 100. In some embodiments, the outer parameter of the second layer 200 is defined by the fold lines 102, 103, 104 at the top and sides, by the outer edge of the arm regions 110 of the first layer 100, and is cut straight across at the bottom. However, other shapes and configurations may be used that provide sufficient coverage of the first layer 100 to make the second layer 200 sufficiently effective at capturing water that might otherwise splash off the outward facing surface of the first layer 100. The outward facing surface is on the side that is not in contact with the wearer when the wearer has the apron on.

Figure 3:
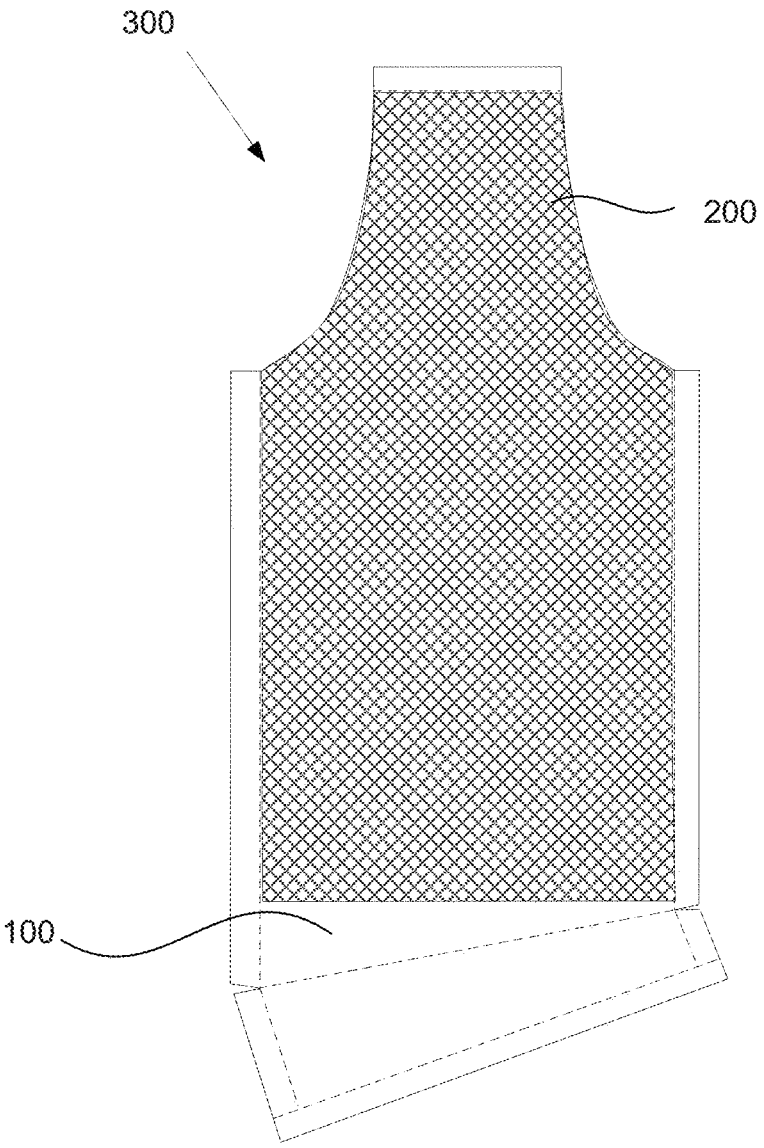
FIG. 3 is a plan view drawing of an apron having a second layer positioned upon a first layer in accordance with one embodiment of the presently disclosed protective wash garment.

FIG. 3 is a plan view drawing of an apron 300 having a second layer 200 positioned upon a first layer 100 in accordance with one embodiment of the presently disclosed protective wash garment. As noted above, the second layer essentially conforms to the shape defined by the fold lines 102, 103, 104, 105 and the arm regions 110. The second layer is secured to the first layer.

Figure 4A:
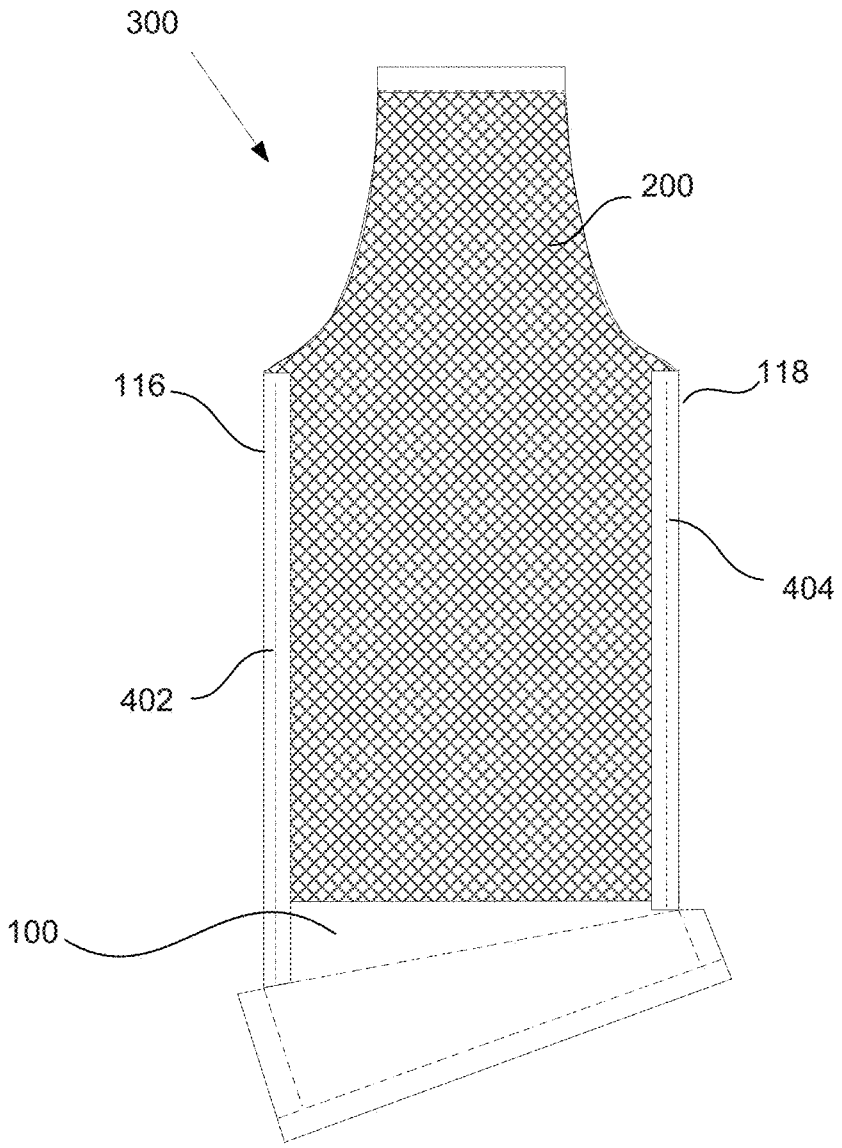
FIG. 4A is a plan view drawing of the two-layer apron upon having the sides of the first layer folded over to partially secure the second layer to the first layer in accordance with one embodiment of the presently disclosed protective wash garment.

FIG. 4A is a plan view drawing of the apron 300 in which the side flap portions 116, 118 have been folded along the fold lines 103, 104 (see FIG. 1), respectively to capture the second layer 200. In some embodiments, stitches 402, 404 are sown along the folded side flap portions 116, 118 to partially secure the second layer 200 to the first layer 100. However, in alternative embodiments, the second layer 200 can be secured to the first layer 100 by other means without the need for folding side flap portions 116, 118, including stitching, glue, staples, Velcro®, etc. In addition, the folded side flap portions 116, 118 can be secured with the second layer captured within the folded side flap portions 116, 118 by means other than by being stitched, such as by glue, staples, tacks, etc. In some embodiments, the second layer may be secured in a manner that allows the second layer 200 to be easily removed. For example, the second layer 200 may be fixed to the first layer using hook and loop fasteners (Velcro®), snaps, buttons, zippers, etc. It should be noted that while the second layer 200 is shown to cover the majority of the area of the first layer 100, in alternative embodiments, the second layer 200 may be placed at strategically selected locations to reduce the cost, weight and bulk of the apron.

Figure 4B:
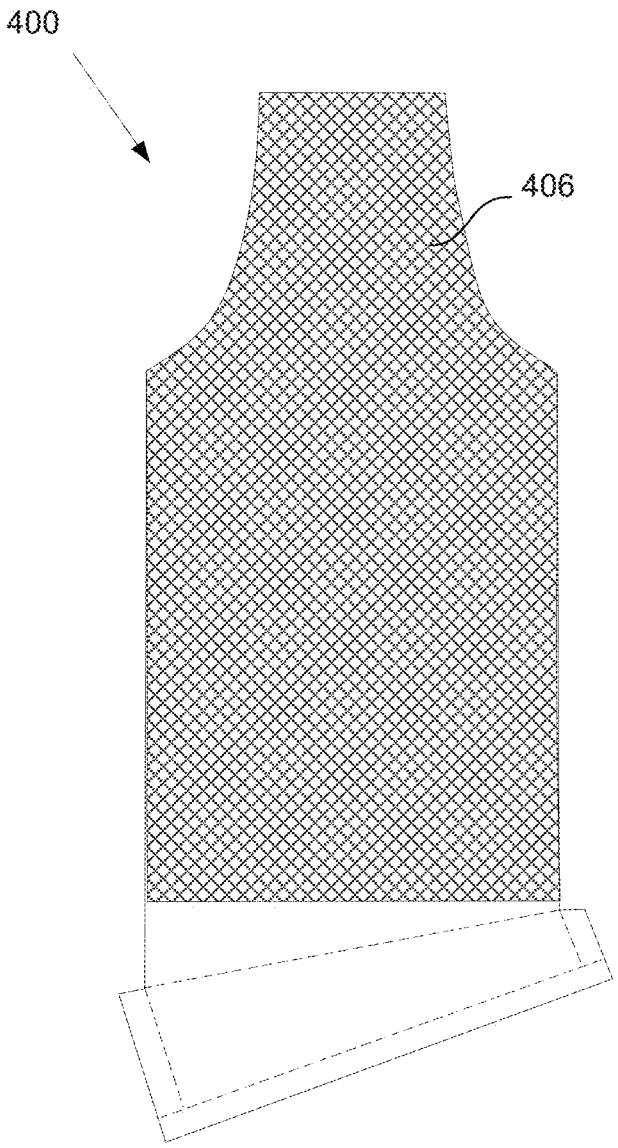
FIG. 4B is a plan view drawing of an alternative apron in which only one layer 406 is provided.

FIG. 4B is a plan view drawing of an alternative apron 400 in which only one layer 406 is provided. The layer 406 has a coating, is etched or otherwise formed to have a texture on the outward facing surface that urges fluid, such as water, to adhere and collect on the surface of the layer 406. In some embodiments, the layer 406 can have folds sown in to create more surface area, and thus increase the ability of the layer 406 to capture water. The water once collected, runs down the outward facing surface of the layer 406. In yet another alternative embodiment, a spray on texture is applied to the outer surface of the layer 406 to create a texture that would mimic the effect of the mesh of the second layer on the water. In some embodiments, the outward facing surface of the layer 406 may have, or be coated with, fibers or hairs that capture and collect fluid. Alternatively, the outward facing surface of the layer 406 may be treated with a chemical hydrophilic coating. In yet another embodiment, a sewing method is used that puckers the surface of the layer 406 repeatedly to help to have a similar effect that that of the mesh in gathering water. In yet one more alternative embodiment, the entire apron may be created from a mesh material with a waterproof backside.

Figure 5:
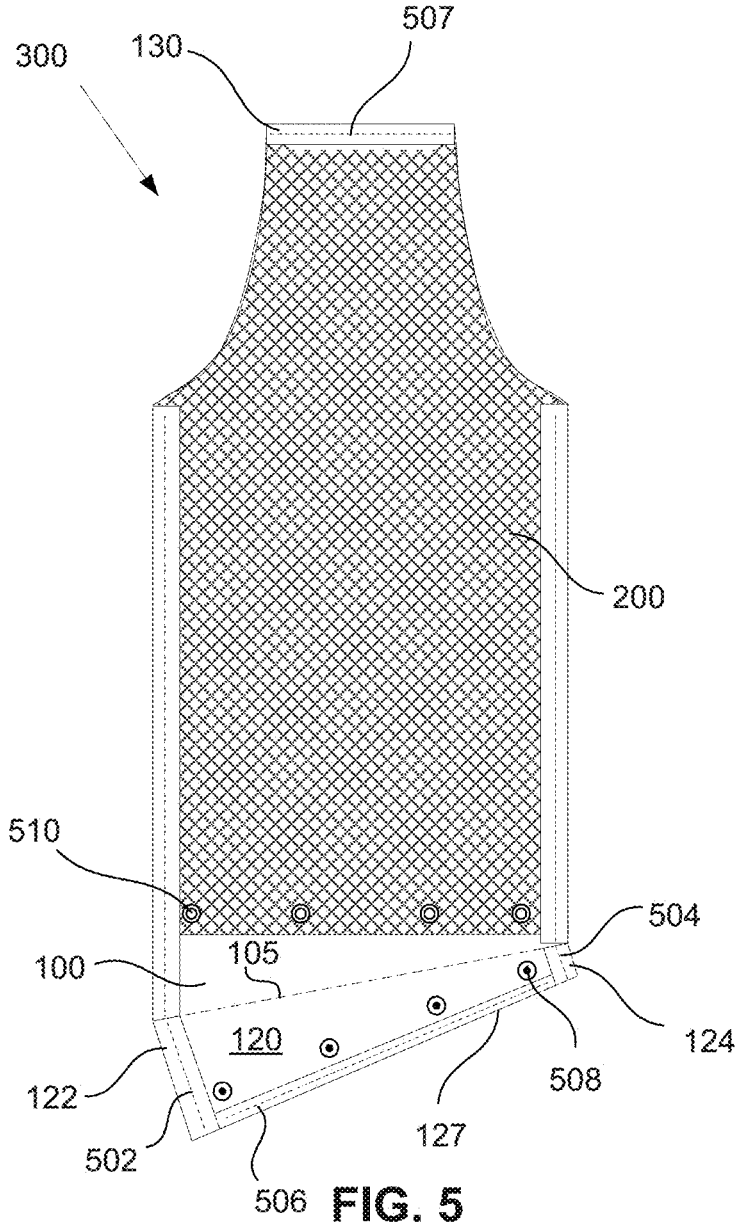
FIG. 5 is a plan view drawing of the two-layer apron upon having the edges of the bottom flap and top portion of the first layer folded over and stitched in accordance with one embodiment of the presently disclosed protective wash garment.

FIG. 5 is a plan view drawing of the two-layer apron 300 upon having the bottom right side flap 122, bottom left side flap 124, bottom center flap 127 and neck flap 130 folded along the fold lines 107, 108, 106, 102 respectively. The folded flaps 122, 124, 127, 130 are stitched in accordance with one embodiment of the presently disclosed protective wash garment. Dotted lines 502, 504, 506, 507 depict the stitching along the flaps 122, 124, 127, 130, respectively. Stitching the flaps 122, 124, 130 assists in securing the second layer 200 to the first layer 100.

As shown in FIG. 5, the bottom center flap 127 is folded first and stitched. The bottom right side flap 122 and bottom left side flap 124 are then folded and stitched. However, the order in which these flaps 122, 124, 127 are folded is not significant. Nonetheless, folding and stitching the bottom center flap 127 provides additional structural integrity to the bottom flap 120. It should be noted that the second layer 200 could cover the first layer 100 down to the bottom of the bottom center flap 127, in some alternative embodiments. However, this provides no additional benefit and would typically only be done if it were deemed simpler to manufacture by the apron 300 by doing so.

In one embodiment, a plurality of sockets 508 and associated socket caps 802 (shown in FIG. 8) of a snap fastener set are inserted into the fabric just above the bottom of the second layer 200. A snap fastener set comprises a socket 508, stud 510, a socket cap 802 and a stud cap (not shown). The socket 508 is configured to securely receive and hold the stud 510. The socket cap 802 resides on inward side of the first layer 100 and so is not visible in either FIGS. 5-7. The inward side is the side in contact with the wear when the wearer has it on. The socket 508 is inserted on the outward side of the second layer 200. The socket cap 802 and the socket 508 mate through material of the first and second layers 100, 200. A stud 510 associated with each of the sockets 508 is secured through the material of the first and second layer 100, 200 by the stub cap. The studs 510 reside on the second layer 200 in a line near the bottom center flap 127. Each of the studs 510 is placed a distance from the fold line 105 that is equal to the distance between the associated socket 508 and the fold line 105. Accordingly, each stud 510 can be mated to its associated socket 508 when the bottom flap 120 is folded up along the fold line 105. Mating the sockets 508 with their associated studs 510 holds the bottom flap 120 up to form a gutter 902 (See FIG. 9), as is described in more detail below. Accordingly, the snaps maintain the fold that forms the gutter. However, it will be clear to those skilled in the art that any mechanism for folding the bottom flap 120 up to form a gutter would be within the scope of the disclosure. For example, the bottom flap 120 can be sewn up rather than being held up by the snaps. In other alternative embodiments, the bottom flap 120 could be held up by buttons, magnetic inserts, glue, rivets or any other means.

Figure 6:
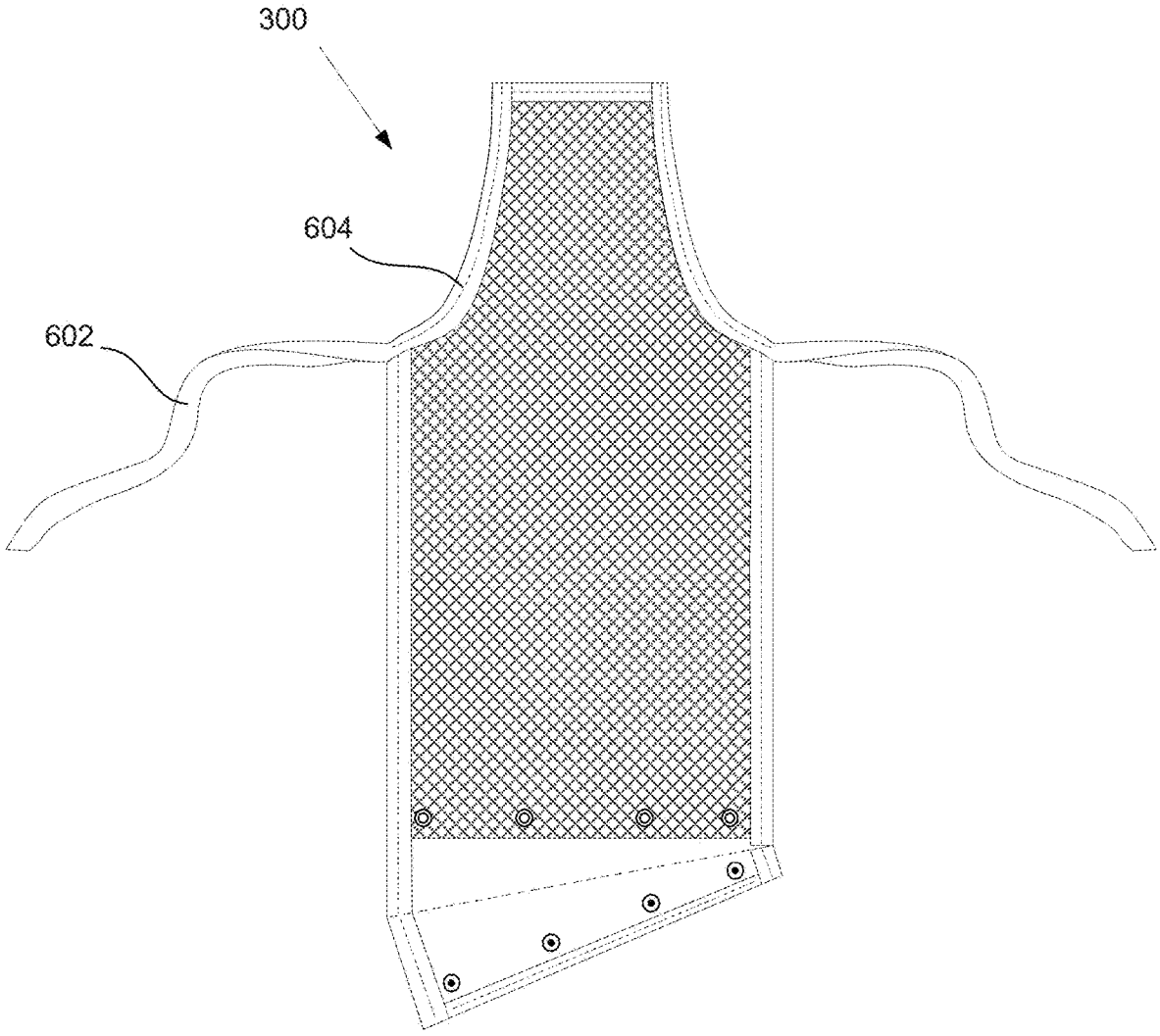
FIG. 6 is a plan view drawing of the two-layer apron upon having a waist strap fixed to the two-layer apron in accordance with one embodiment of the presently disclosed protective wash garment.

FIG. 6 is a plan view drawing of the two-layer apron 300 with a waist strap 602 stitched along the arm regions 110. The waist strap 602 extends beyond the first and second layers 100, 200 to allow the wearer to secure the waist strap 602 around the wearer's waist. The waist strap 602 is shown without a buckle. The ends can be tied together to close the apron 300. However, in an alternative embodiment, the strap can be a belt with holes on one side and a buckle on the other.

In the embodiment shown in FIG. 6, the waist strap is laid with the longitudinal axis of the waist strap 602 resting along the edge of the arm region 100 of the apron 300. The waist strap 602 is then folded over, such that half the width of the waist strap 602 is on the outward side of the second layer 200 and half the width of the waist strap 602 is on the inward side of the first layer 100. The waist strap 602 is then stitched to secure it to the apron 300. The dotted line 604 illustrates the stitching. Alternative means for fixing the waist strap 602 to the apron 300 can be used, such as gluing, stapling, etc.

Figure 7:
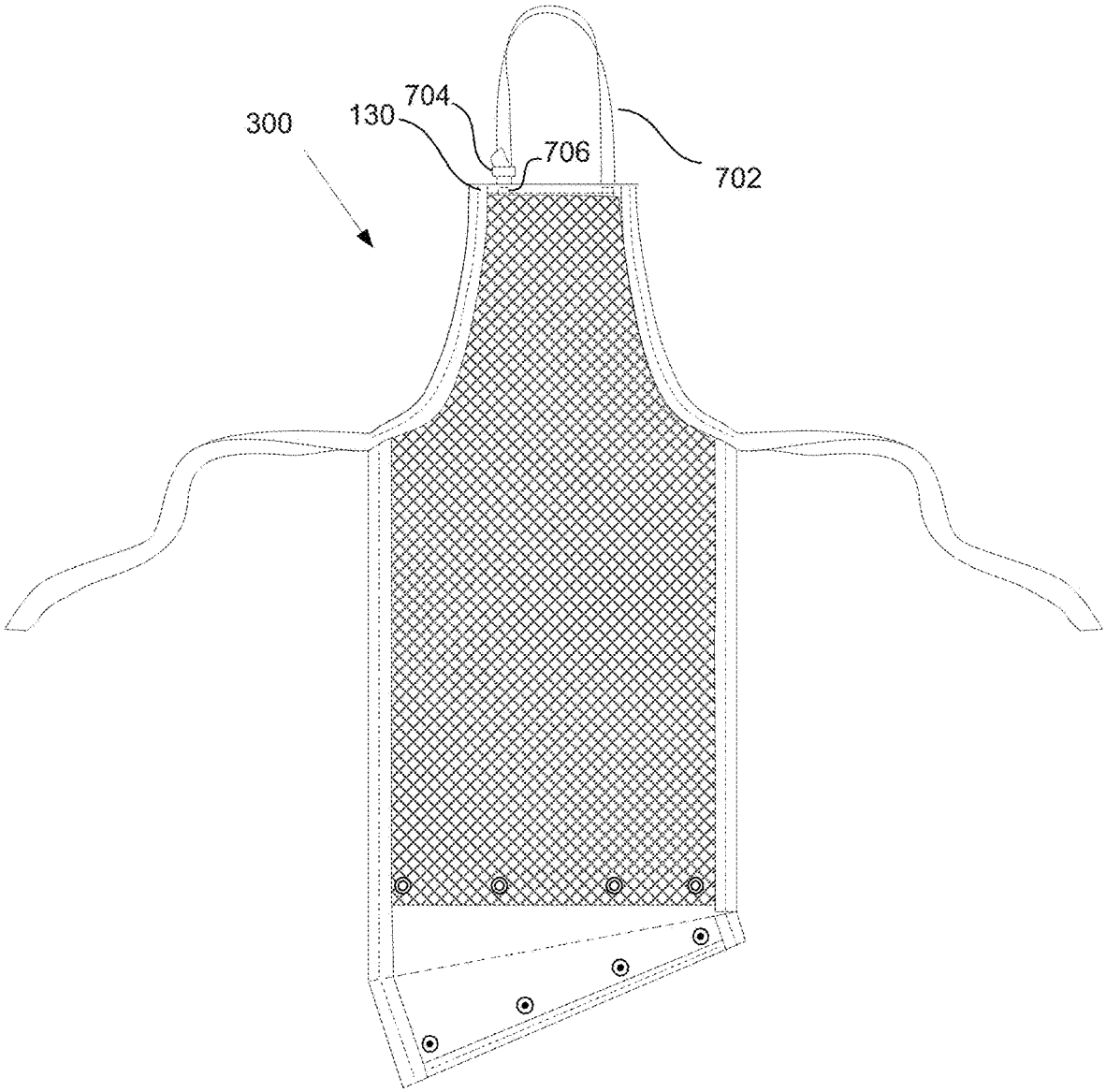
FIG. 7 is a plan view drawing of the two-layer apron upon having a neck strap fixed to the top of the apron in accordance with one embodiment of the presently disclosed protective wash garment.

FIG. 7 is a plan view drawing of the apron 300 in which a neck strap 702 is added. The neck strap 702 holds the top portion of the apron 300 to the chest of the wearer. A double loop buckle 704 or other such fixture is provided to allow the length of the neck strap 702 to be adjusted. The neck strap 702 is stitched 706 or otherwise secured to the neck flap 130.

Figure 8:
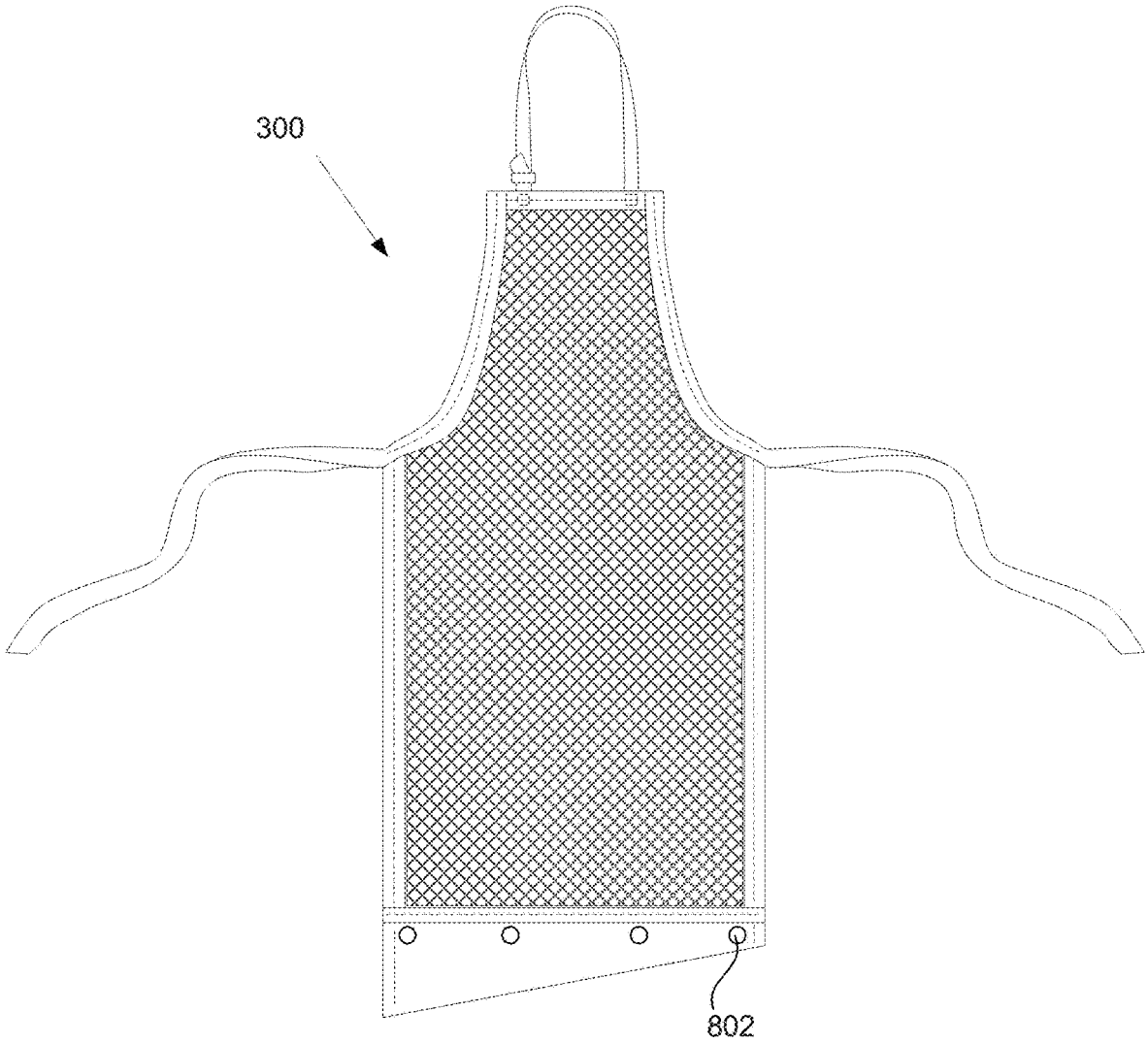
FIG. 8 is a plan view drawing of the two-layer apron with the bottom flap folded up to form the gutter in accordance with one embodiment of the presently disclosed protective wash garment.

FIG. 8 is a plan view drawing of the apron 300 with the bottom flap 170 folded up along the fold line 105 (see FIG. 1). The studs 510 (see FIG. 5) on the other side of the snap fastener caps 802 are mated to the sockets 508 (see FIG. 5) to hold the bottom flap 105 folded in position. The fold in the bottom flap 120 creates a gutter along the fold line 105. Water that comes in contact with the outward facing surface 804 of the apron 300 runs down the outward facing surface. In some embodiments, a pocket (not shown) sized to fit a cellular phone can be sown onto the inward facing surface of the first layer 100. In some such embodiments, the pocket can be closed to form a water resistant storage space for papers, a cellular phone, cigarettes, etc.

Figure 9:
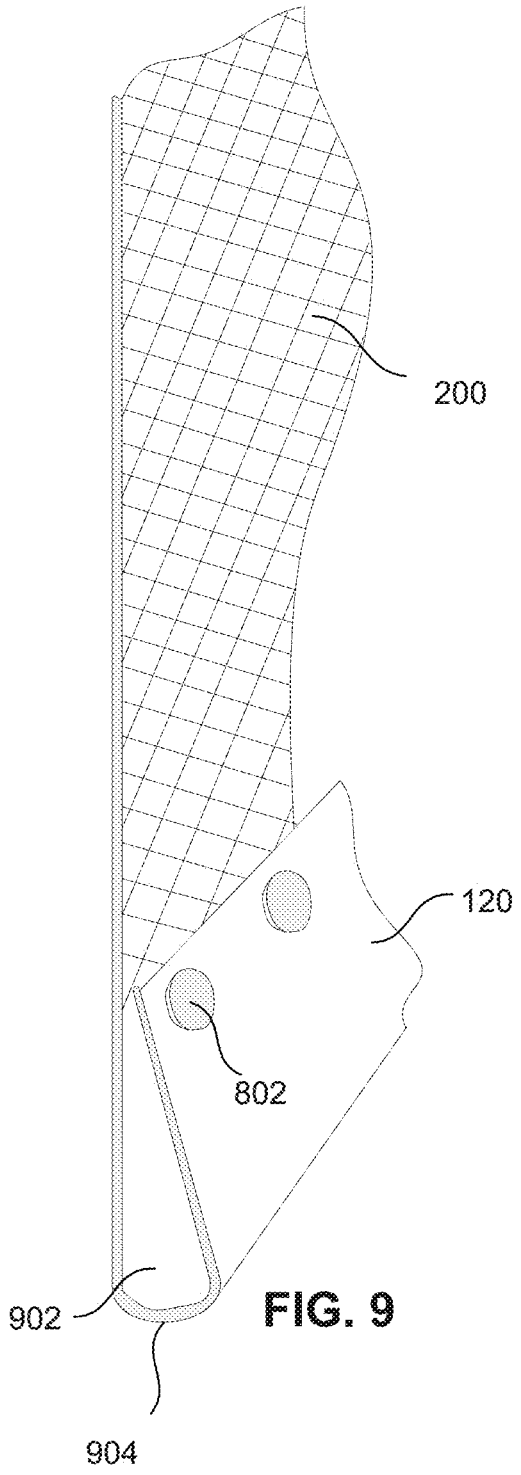
FIG. 9 is a cutaway perspective view of a section of the bottom of the apron with the bottom flap folded up.

FIG. 9 is a cutaway perspective view of a section of the bottom of the apron 300 with the bottom flap 120 folded up. A gutter 902 is formed by folding of the bottom flap 120 at the lower portion of the garment. Water that is captured between the first layer 100 and the mesh of the second layer 200 runs down into the gutter 902. The bottom flap is folded such that the second layer 200 terminates within the gutter 902. Since the second layer terminates with the gutter 902, the water that runs down is captured in the gutter 902. In some embodiments, the bottom flap 120 is folded at an angle. Due to the angle on which the bottom flap 120 is folded up, one end 904 of the gutter 902 is higher than the other end (not shown). Accordingly, the gutter 902 is at an angle to facilitate the water running to one end of the gutter 902 and draining out. Alternatively, the gutter 902 may be raised in the center and lower at both ends so that water will exit at both sides of the bottom flap 120. In alternative embodiments, the bottom flap 120 may be folded straight across. In the embodiment shown in FIG. 9, the water runs to the right side 904 of the apron 300. When the apron 300 is donned by a worker, the water that drains from the gutter 902 will fall to the side of the worker's feet. In the embodiment shown in FIG. 9 in which the bottom flap 120 is folded such that the right side 904 of the gutter 902 is lower than the left side of the gutter 902, the water will drain to the right of the worker's feet.

Figure 10:
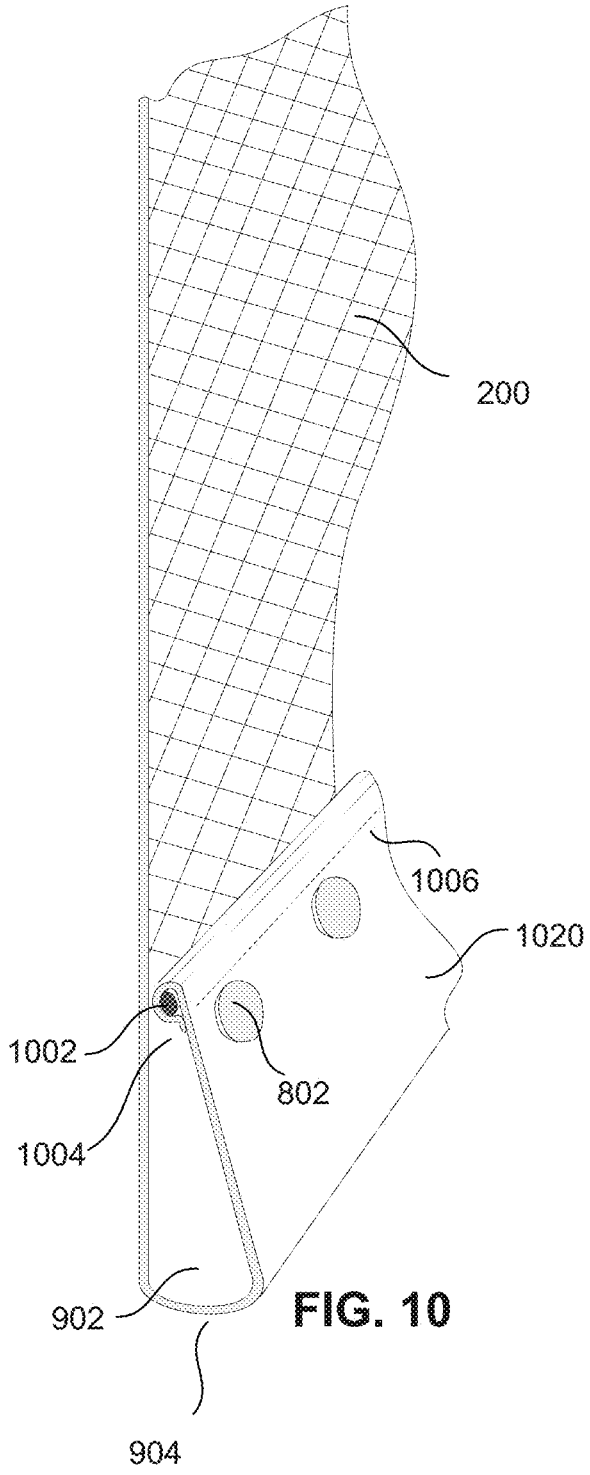
FIG. 10 is a cutaway perspective view of a section of the bottom of the apron.

FIG. 10 is a cutaway perspective view of a section of the bottom of an alternative embodiment to the apron 300. A bottom flap 1020 is folded up, similar to the bottom flap 120 of the apron 300 of FIG. 9. However, the bottom flap 1020 has a piping 1002 provided within a lip 1004 of the bottom flap 1020. The piping 1002 has a relatively short diameter. Nonetheless, the piping 1002 is sufficiently stiff to provide stability to the shape of the gutter 902 formed by the bottom flap 1020. In addition, providing piping 1002 in the lip 1004 of the bottom flap 1020 assists in retaining water within the gutter 902, making it less likely that water will spill out over the lip 1004 onto the shoes of the worker wearing the garment. The lip 1004 curls around the piping 1002. Stitching 1006 shown as a dotted line closes the lip 1004 around the piping 1002 in the embodiment shown in FIG. 10. However, the lip 1004 can be closed around the piping 1002 any other means, such as gluing, stapling or any through the use of any other mechanism that ensures that the piping 1002 remains in place within the lip 1004.

Figure 11:
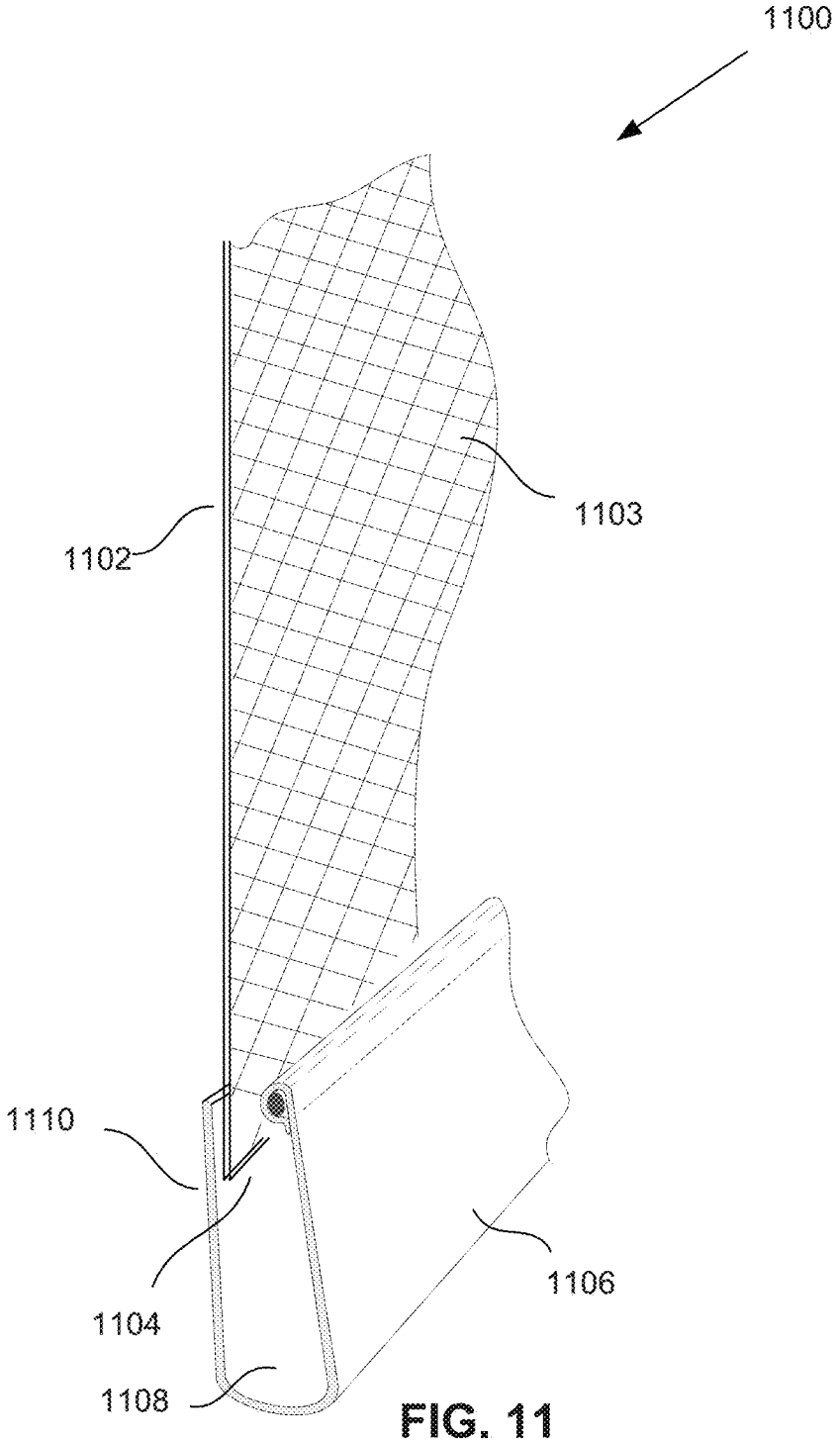
FIG. 11 is an illustration of the bottom portion of an alternative embodiment of an apron having a gutter.

FIG. 11 is an illustration of the bottom portion of an alternative embodiment of an apron having a gutter. The apron 1100 shown in FIG. 11 is similar to the apron 300 shown in FIGS. 1-9, however, the bottom flap 120 of the apron 300 is not present in the apron 1100. Furthermore, in some embodiments of the apron 1100, the bottom of the first layer 1102 is cut straight across at the bottom 1104 and terminates along the same line as the second layer 1103. A bottom flap 1106 is a separate detached piece of material that is folded around the bottom 1104 of the first and second layers 1102, 1103 to form a gutter 1108 to catch fluid that might run down to the bottom of the first layer 1102. The bottom flap 1106 may be fixed to the inward face of the first layer 1102 by any means, including being sewn, glued, stapled, etc. Furthermore, in some embodiments, the bottom flap 1106 may be removably fixed to the first layer 1102, such as being snapped, attached by hook and loop (e.g., Velcro®), etc. The bottom flap 1106 may be held in a desired generally "U" shape by virtue of the material from which the bottom flap 1106 is fabricated. For example, the bottom flap 1106 may be a section of PVC piping that is open along the longitudinal axis to allow the first and second layers 1102, 1103 to enter the bottom flap 1106. Alternatively, the bottom flap 1106 may have a stiffening piping (not shown) sown into the edge 1110 of the bottom flap 1106 or by fixing the distal end 1112 of the bottom flap 1106 to the outward facing surface of the first layer 1102. It should be noted that the features shown in FIG. 5 through FIG. 11 may apply equally well to a single layer construction, such as shown in FIG. 4B.

Figure 12:
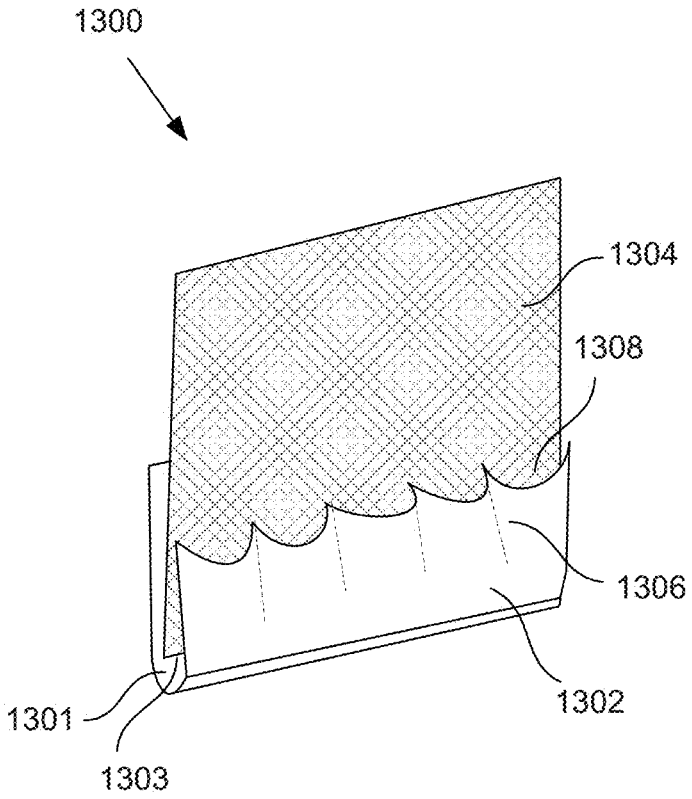
FIG. 12 is a perspective view of the bottom of an apron in which the gutter is formed by wrapping a bottom flap around the bottom edge of a first layer.

FIG. 12 is a perspective view of the bottom of an apron 1300 in which the gutter 1301 is formed by wrapping a bottom flap 1302 around the bottom edge 1303 of a first layer 1304. The bottom flap 1302 stitched at intervals along lines 1306 to form pockets 1308 to catch water that might otherwise splash beyond the bottom flap 1302 and land on the feet of the person wearing the apron 1300. Alternatively, the bottom flap 1302 may be made to extend out from the layer 1304 to allow the bottom flap 1302 to catch water that might otherwise bounce off the outward facing surface of the first layer 1304.

A number of embodiments of the claimed invention have been described. It is to be understood that various modifications may be made without departing from the spirit and scope of the invention. For example, some of the steps described above may be order independent, and thus can be performed in an order different from that described. Further, some of the steps described above may be optional. Various activities described with respect to the methods identified above can be executed in repetitive, serial, or parallel fashion. It is to be understood that the foregoing description is intended to illustrate and not to limit the scope of the claimed invention, which is defined by the scope of the following claims, and that other embodiments are within the scope of the claims.

What is claimed is:

1. An apron consisting of:

(a) a first layer formed of water resistant material and having a top and an arm region and forming a chest covering such that when the apron is worn by a wearer, the top will cover the wearer from the wearer's neckline down to the wearer's breast area with increasing width and reaching full width below an arm region and shaped to allow the arms of the wearer to extend from the arm region;

(b) a second exterior layer consisting of a mesh material having a first and second side, the first side set upon the first layer and having a contour similar to the first layer, the second side of the second exterior layer being uncovered so as to be exposed to a potential source of fluid, the mesh being sufficiently open to capture droplets of fluid splashed thereon and to allow such droplets of fluid to freely run down the first layer; and (c) a bottom flap formed from the first layer material and opposite the top of the first layer, folded to form a gutter at the lower portion of the apron, such that the second exterior layer of material terminates below the wearer's breast area and within the gutter, the gutter capturing the droplets of fluid that freely run down the first layer.

2. The apron of claim 1, wherein the mesh material is a screen.

3. The apron of claim 1, wherein the mesh material is a polypropylene screening.

4. The apron of claim 1, wherein the mesh structure is a vinyl coated fiberglass screening.

5. The apron of claim 2, wherein the second exterior layer is a vinyl mesh.

6. The apron of claim 1, wherein the bottom flap is folded at an angle to have a first end of the gutter lower than a second end of the gutter.

7. The apron of claim 6, wherein the bottom flap of the first layer comprises a lip.

8. The apron of claim 1, wherein the first side of the second exterior layer is secured to the first layer.

9. The apron of claim 8, wherein the first layer comprises side flap portions and wherein the second exterior layer is secured to the first layer by folding over the side flap portions to capture the second exterior layer.

10. An apron consisting of:

(a) a first layer formed of water resistant material and having a top and an arm region and forming a chest covering such that when the apron is worn by a wearer, the top will cover the wearer from the wearer's neckline down to the wearer's breast area with increasing width and reaching full width below an arm region and shaped to allow the arms of the wearer to extend from the arm region;

(b) a second exterior layer consisting of a mesh material having a first and second side, the first side set upon the first layer having a contour similar to the first layer, the second side of the second exterior layer being uncovered so as to be exposed to a potential source of fluid, the mesh being sufficiently open to capture droplets of fluid splashed thereon and to allow such droplets of fluid to freely run down the first layer;

(c) a bottom flap formed from the first layer material and opposite the top of the first layer, folded to form a gutter at the lower portion of the apron, such that the second exterior layer of material terminates below the wearer's breast area and within the gutter, the gutter capturing the droplets of fluid that freely run down the first layer; and (d) stitches placed in the side flap portions of the first layer to secure the second exterior layer to the first layer.

11. The apron of claim 8, wherein the garment conforms to the shape of an apron.

12. An apron consisting of:

(a) a first layer formed of water resistant material and having a top and an arm region and forming a chest covering such that when the apron is worn by a wearer, the top will cover the wearer from the wearer's neckline down to the wearer's breast area with increasing width and reaching full width below an arm region and shaped to allow the arms of the wearer to extend from the arm region;

(b) a second exterior layer consisting of a mesh material having a first and second side, the first side set upon the first layer having a contour similar to the first layer, the second side of the second exterior layer being uncovered so as to be exposed to a potential source of fluid, the mesh being sufficiently open to capture droplets of fluid splashed thereon and to allow such droplets of fluid to freely run down the first layer;

(c) a bottom flap formed from the first layer material and opposite the top of the first layer, folded to form a gutter at the lower portion of the apron, such that the second exterior layer of material terminates below the wearer's breast area and within the gutter, the gutter capturing the droplets of fluid that freely run down the first layer; and (d) snap fastener sets, the snap fastener sets comprising a socket, stud, socket cap and stud cap, the snap fastener sets placed to maintain the fold that forms the gutter.

* * * * *